US010960691B2

(12) United States Patent
Yazawa et al.

(10) Patent No.: US 10,960,691 B2
(45) Date of Patent: Mar. 30, 2021

(54) ROLL PAPER PRINTER

(71) Applicant: NEC Platforms, Ltd., Kawasaki (JP)

(72) Inventors: Shou Yazawa, Kanagawa (JP); Yukio Yoshioka, Kanagawa (JP)

(73) Assignee: NEC Platforms, Ltd., Kawasaki (JP)

( * ) Notice: Subject to any disclaimer, the term of this patent is extended or adjusted under 35 U.S.C. 154(b) by 0 days.

(21) Appl. No.: 16/317,888

(22) PCT Filed: Jul. 11, 2017

(86) PCT No.: PCT/JP2017/025275

§ 371 (c)(1),
(2) Date: Jan. 15, 2019

(87) PCT Pub. No.: WO2018/012499

PCT Pub. Date: Jan. 18, 2018

(65) Prior Publication Data

US 2019/0291481 A1 Sep. 26, 2019

(30) Foreign Application Priority Data

Jul. 15, 2016 (JP) ..... JP2016-140010

(51) Int. Cl.
*B41J 15/04* (2006.01)
*B65H 16/08* (2006.01)
(Continued)

(52) U.S. Cl.
CPC ..... *B41J 15/04* (2013.01); *B41J 15/042* (2013.01); *B65H 16/08* (2013.01); *B65H 23/085* (2013.01); *B65H 23/26* (2013.01)

(58) Field of Classification Search
CPC ..... B41J 15/04; B41J 15/042; B65H 23/26; B65H 23/085; B65H 16/08;
(Continued)

(56) References Cited

U.S. PATENT DOCUMENTS 3,834,635 A 9/1974 Pfarrwaller
3,932,915 A 1/1976 Contractor et al.
(Continued)

FOREIGN PATENT DOCUMENTS

CN 1172021 A 2/1998
CN 1530238 A 9/2004
(Continued)

OTHER PUBLICATIONS

Machine translation of JP 2015-134655 A. (Year: 2015).*
(Continued)

*Primary Examiner* — Justin Ceo
(74) *Attorney, Agent, or Firm* — Sughrue Mion, PLLC

(57) ABSTRACT

A printer is provided with a roll paper holding portion that holds roll paper without axially supporting the roll paper; a sheet conveying unit that conveys a sheet supplied from the roll paper; a printing unit that executes printing on the sheet; and a roll paper pressing unit that presses the roll paper held in the roll paper holding portion, wherein the roll paper pressing unit is provided with a pressing roller that presses the roll paper and rotates along with the sheet conveyance, and a rotation suppressing portion that suppresses the rotation of the pressing roller.

3 Claims, 9 Drawing Sheets

(51) Int. Cl.
*B65H 23/26* (2006.01)
*B65H 23/08* (2006.01)

(58) Field of Classification Search
CPC ..... B65H 2403/725; B65H 2801/12; B65H 2513/40; B65H 2404/561; B65H 2404/1521; B65H 2404/43
See application file for complete search history.

(56) References Cited

U.S. PATENT DOCUMENTS

| | | | |
|---|---|---|---|
| 3,972,489 | A | 8/1976 | Kovaleski |
| 4,089,086 | A | 5/1978 | Contractor et al. |
| 4,521,007 | A | 6/1985 | Darda |
| 2002/0060260 | A1 | 5/2002 | Imai et al. |
| 2004/0234316 | A1 | 11/2004 | Matsuse et al. |
| 2008/0179444 | A1 | 7/2008 | Takeuchi |
| 2010/0071799 | A1 | 3/2010 | Pedrini et al. |

FOREIGN PATENT DOCUMENTS

| | | | |
|---|---|---|---|
| CN | 101713117 | A | 5/2010 |
| CN | 202965527 | U | 6/2013 |
| CN | 104444492 | A | 3/2015 |
| CN | 204503821 | U | 7/2015 |
| CN | 204508352 | U | 7/2015 |
| CN | 105460652 | A | 4/2016 |
| CN | 105712109 | A | 6/2016 |
| CN | 205294382 | U | 6/2016 |
| EP | 1 867 769 | A1 | 12/2007 |
| JP | 50-095995 | U | 8/1975 |
| JP | 51-55431 | A | 5/1976 |
| JP | 2-81853 | A | 3/1990 |
| JP | 3-82347 | U | 8/1991 |
| JP | 04-176674 | A | 6/1992 |
| JP | 04-179663 | A | 6/1992 |
| JP | 2004-268444 | A | 9/2004 |
| JP | 2009-096595 | A | 5/2009 |
| JP | 2011-046476 | A | 3/2011 |
| JP | 2015-134655 | A | 7/2015 |

OTHER PUBLICATIONS

Machine translation of JP 04-176674 A. (Year: 1992).*
Notification of Reasons for Refusal of Japanese Application No. 2017-156992 dated Dec. 6, 2017.
International Search Report of PCT/JP2017/025275 dated Aug. 8, 2017 [PCT/ISA/210].
Written Opinion of PCT/JP2017/025275 dated Aug. 8, 2017 [PCT/ISA/237].
Communication dated Jan. 2, 2020 from the China National Intellectual Property Administration in Application No. 201780039910.2.
Communication dated May 16, 2018 from Japanese Patent Office in JP Application No. 2018-082755.

* cited by examiner (a)

(b)

ROLL PAPER PRINTER

This application is a National Stage of International Application No. PCT/JP2017/025275, filed Jul. 11, 2017, claiming priority based on Japanese Patent Application No. 2016-140010, filed Jul. 15, 2016, the contents of all of which are incorporated herein by reference in their entirety.

TECHNICAL FIELD

This invention relates to a roll paper printer and, more particularly, to a structure in which a sheet of roll paper is fed to a sheet conveying unit in a roll paper holding portion.

BACKGROUND ART

In recent years, a roll paper printer has been used for various purposes. As a structure for holding roll paper in the roll paper printer, there are known an axial-support type in which a center of the roll paper is supported, and a throw-in type (drop-in type) in which the roll paper is held without being axially supported.

The technology relating to a roll paper printer of the throw-in type is described in Patent Document 1.

The roll paper printer described in Patent Document 1 includes a roll holding portion which is configured to hold the roll paper in the manner of the throw-in type, and a roll paper pressing roller (reference symbol 41 in the Patent Document) which is kept in a state of being pressed against an outer peripheral surface of the roll paper while following a change in outer shape of the roll paper.

PRIOR ART DOCUMENT(S)

Patent Document(s)

Patent Document 1: JP 2009-96595 A

SUMMARY OF THE INVENTION

Problem to be Solved by the Invention

In the roll paper printer of the throw-in type without the roll paper pressing roller, during conveyance of the sheet, the roll paper frequently moves (rolls) in the holding portion, for example, in an up-and-down direction. The movement of the roll paper, for example, in the up-and-down direction acts as a load on a sheet conveying unit during conveyance of the sheet. The rolling of the roll paper may cause adverse effects on conveyance of the sheet. For example, there is a fear in that slippage occurs during conveyance of the sheet so that printing is not performed normally. Further, after conveyance of the sheet is started and then finished (stopped), slackness of the sheet is caused by an inertial force of the roll paper. The slackness of the sheet leads to fluctuation in load on the sheet conveying unit when the slackness is eliminated along with conveyance of the sheet at the time of subsequent printing. As a result, slippage may occur during conveyance of the sheet so that printing is not performed on the sheet normally. Further, large slackness of the sheet may cause a paper jam.

The roll paper printer described in Patent Document 1 includes the roll paper pressing roller. Action of the roll paper pressing roller reduces rolling caused in the roll holding portion during conveyance of the sheet. However, in Patent Document 1, no description is made of suppressing occurrence of slackness of the sheet fed from the roll paper.

This invention has been made in view of the above-mentioned problems, and provides a roll paper printer including a roll paper holding portion capable of suppressing rolling of roll paper and occurrence of slackness of a sheet.

Means to Solve the Problem

A roll paper printer according to one embodiment of this invention includes a roll paper holding portion configured to hold roll paper without axially supporting the roll paper; a sheet conveying unit configured to convey a sheet fed from the roll paper; a printing unit configured to perform printing on the sheet; and a roll paper pressing unit configured to press the roll paper held in the roll paper holding portion, wherein the roll paper pressing unit includes a pressing roller configured to press the roll paper and rotate along with conveyance of the sheet; and a rotation suppressing portion configured to suppress rotation of the pressing roller by a frictional force.

Effect of the Invention

According to this invention, it is possible to provide the roll paper printer including the roll paper holding portion capable of suppressing rolling of the roll paper and occurrence of slackness of the sheet.

BRIEF DESCRIPTION OF THE DRAWING

(FIG. 2 (*a*) is a perspective view for illustrating only the roll paper pressing unit, and FIG. 2 (*b*) is a sectional view for illustrating a vicinity of a center portion of the roll paper pressing unit.)

MODE(S) FOR EMBODYING THE INVENTION

Now, an embodiment of this invention is described with reference to the drawings.

EMBODIMENT

Figure 1A:
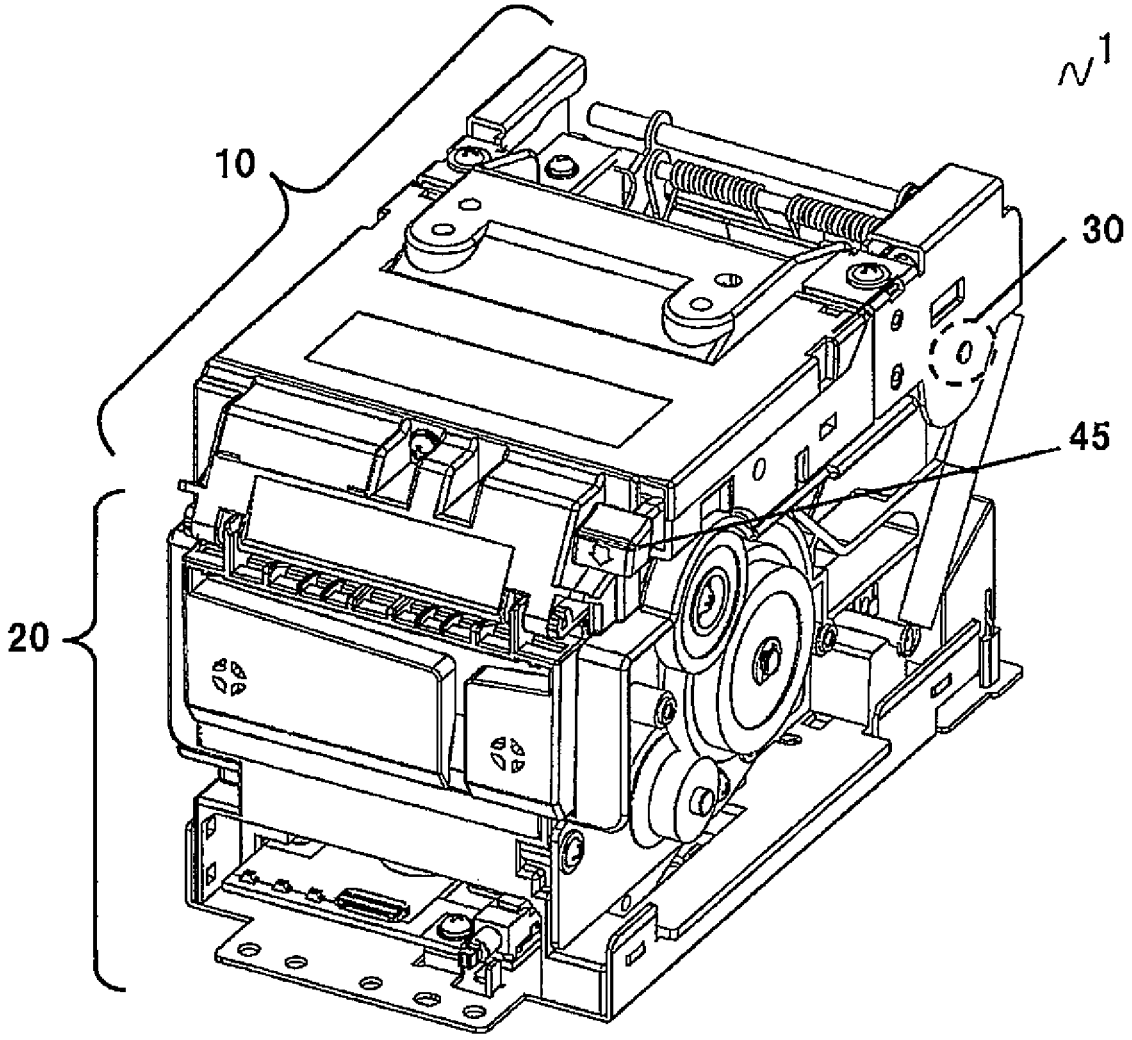
FIG. 1A is a perspective view for illustrating a roll paper printer 1 having a roll paper holding structure according to one embodiment of this invention in a state in which an upper frame is closed.
Figure 1B:
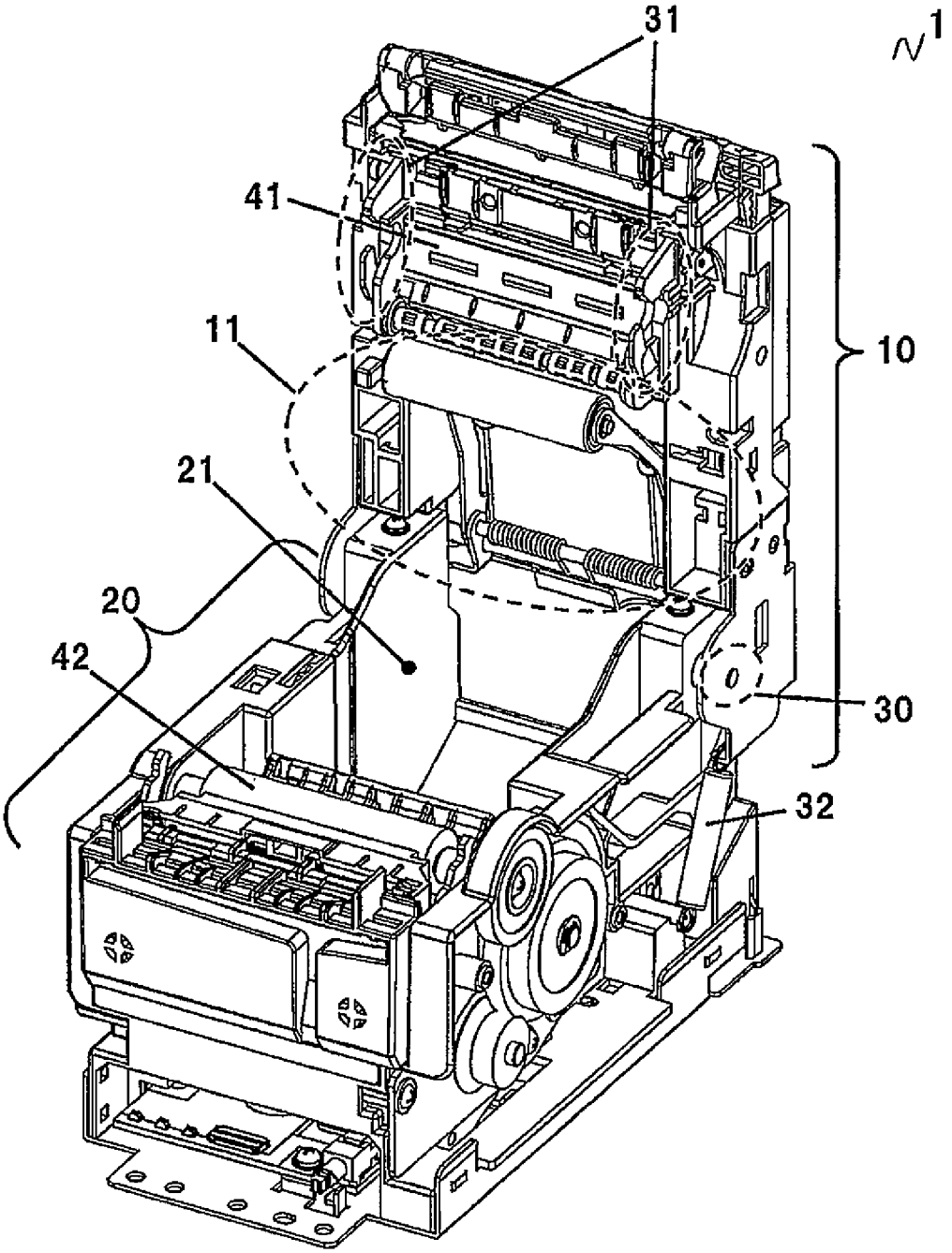
FIG. 1B is a perspective view for illustrating the roll paper printer 1 having the roll paper holding structure according to the embodiment of this invention in a state in which the upper frame is opened.
Figure 2:
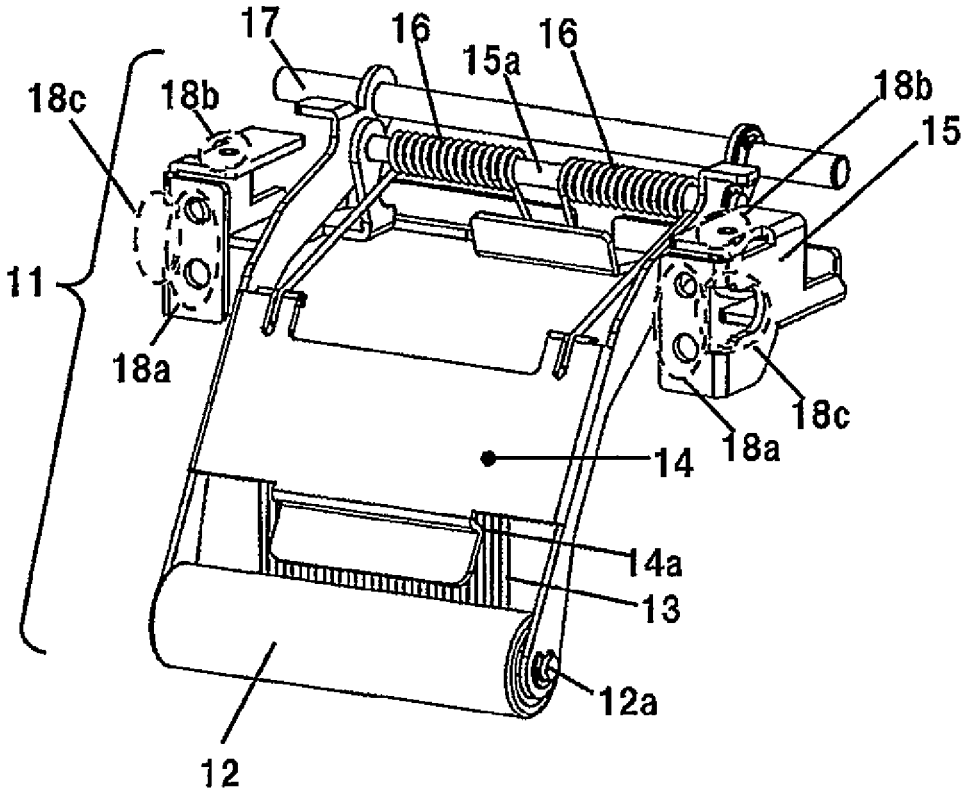
FIG. 2 includes views for illustrating a roll paper pressing unit 11 to be used for the roll paper holding structure in the embodiment.
Figure 2:
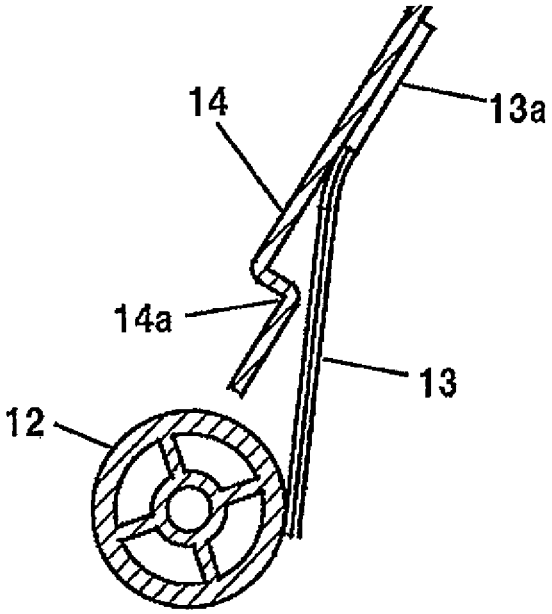

FIG. 1A and FIG. 1B are perspective views for illustrating a roll paper printer 1 having a roll paper holding structure according to one embodiment of this invention. FIG. 1A is a perspective view for illustrating a state in which an upper frame is closed, and FIG. 1B is a perspective view for illustrating a state in which the upper frame is opened, that is, a state in which replacement of roll paper can be performed. FIG. 2 includes views for illustrating a roll paper pressing unit 11 to be used for the roll paper holding structure of this invention.

The roll paper printer 1 according to this embodiment is a thermal printer of a throw-in type that uses roll paper 2 being heat-sensitive paper. The roll paper printer 1 includes an upper frame 10 and a lower frame 20. When engagement portions 31 and a shaft of a platen roller 42 are disengaged from each other through operation of a disengaging lever 45, the upper frame 10 is pivotable about a pivot shaft portion 30 relative to the lower frame 20. The state in which the upper frame 10 is opened as illustrated in FIG. 1B is maintained by springs 32, which are provided on both side surfaces and configured to assist pivoting of the upper frame 10.

Figure 3A:
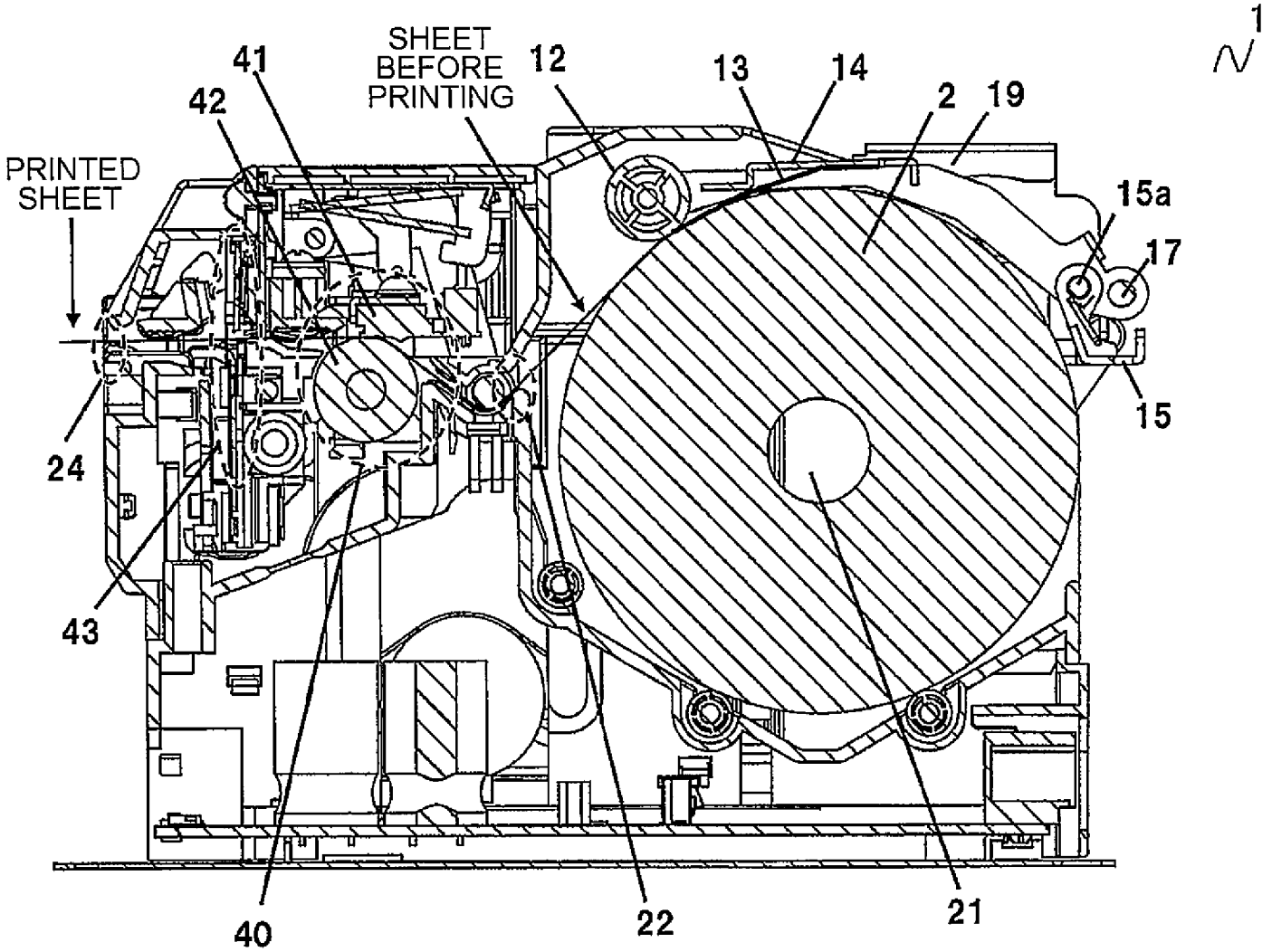
FIG. 3A is a sectional view for illustrating the roll paper printer 1 having the roll paper holding structure according to the embodiment when roll paper 2 has a maximum diameter.
Figure 3B:
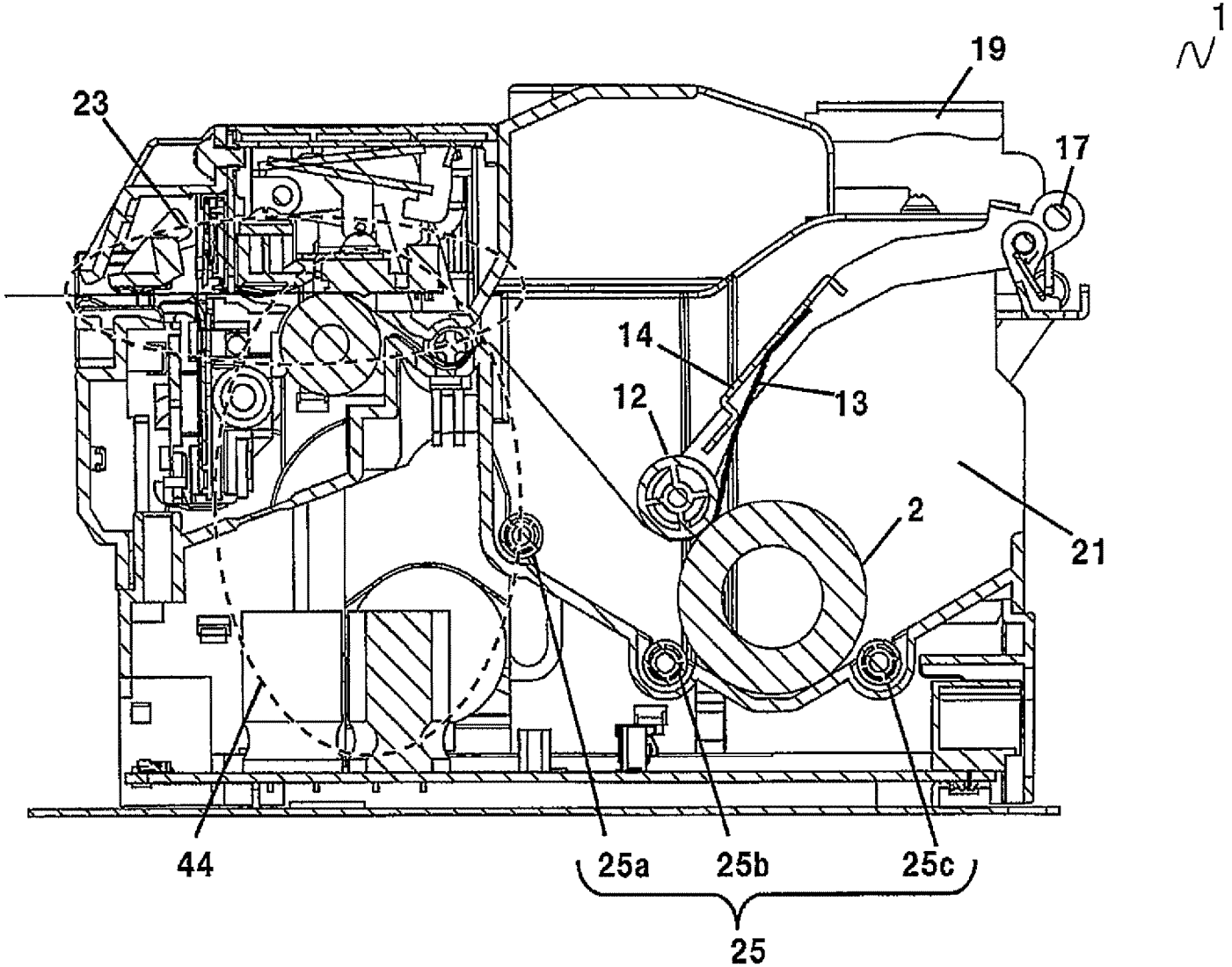
FIG. 3B is a sectional view for illustrating the roll paper printer 1 having the roll paper holding structure according to the embodiment when the roll paper 2 has a small diameter.

In the roll paper printer 1 according to this embodiment, the roll paper pressing unit 11 is provided to the upper frame 10, and a roll paper holding portion 21 (its bottom surface structure is illustrated in FIG. 3A and FIG. 3B) is provided in the lower frame 20. Further, an upper constituent part of a sheet cutting unit 43, a thermal head 41, and the like are provided to the upper frame 10, and a lower constituent part of the sheet cutting unit 43, the platen roller 42, a driving motor (not shown) of a sheet conveying unit 44, and the like are provided to the lower frame 20.

The roll paper printer 1 is configured to receive the roll paper 2 by the roll paper holding portion 21 and the roll paper pressing unit 11 without axially supporting the roll paper 2, and is configured to perform printing on a sheet fed from the roll paper 2. The roll paper pressing unit 11 includes a pressing roller 12 and a rotation suppressing portion 13. The pressing roller 12 is configured to press the roll paper 2, and is rotated along with conveyance of the sheet. The rotation suppressing portion 13 is configured to suppress rotation of the pressing roller 12.

The sheet fed from the roll paper 2 is conveyed through rotation of the platen roller 42 while being sandwiched by the thermal head 41 and the platen roller 42 provided in the sheet conveying unit 44, and printing is performed on the sheet by the thermal head 41. After the printing is finished, the sheet is cut by the sheet cutting unit 43. A rotational force is transmitted from the driving motor to the platen roller 42 through a transmission mechanism such as a gear (not shown). The sheet conveying unit 44 includes the thermal head 41, the platen roller 42, the driving motor, the gear, and the like.

FIG. 2 includes views for illustrating the roll paper pressing unit 11 to be used for the roll paper receiving structure. FIG. 2 (*a*) is a perspective view for illustrating only the roll paper pressing unit 11, and FIG. 2 (*b*) is a sectional view for illustrating a vicinity of a center portion of the roll paper pressing unit 11.

As illustrated in the drawings, in the roll paper pressing unit 11, the pressing roller 12 and a brush 13 are fixed to an arm 14. The pressing roller 12 is configured to press the roll paper 2. The brush 13 serves as the rotation suppressing portion configured to suppress rotation of the pressing roller 12 by a frictional force. The roll paper pressing unit 11 includes a base portion 15. The arm 14 is pivoted about a pivot shaft 15*a*. Further, torsion coil springs (torsion bar springs) 16 configured to urge the arm 14 downward are assembled to the pivot shaft 15*a*. Further, a retreat shaft 17 is provided to the arm 14 on a side opposite to the pressing roller 12 with respect to the pivot shaft 15*a*.

The pressing roller 12 is mounted to an end portion of the arm 14 so as to be rotatable, and is rotated about a rotation shaft 12*a* along with conveyance of the sheet. The pressing roller 12 in this embodiment is made of plastic, and other components are made of metal. On each of right and left sides of the base portion 15, there are formed two positioning holes 18*a*, one screw mounting hole 18*b*, and a fitting portion 18*c*. The fitting portion 18*c* is fitted to the pivot shaft for the upper frame and the lower frame.

As illustrated in FIG. 2 (*b*), the brush 13 made of plastic is mounted to a back surface of the arm 14 at a bonding surface portion 13*a* of the brush. Without being held in abutment against a portion of a corner 14*a* of the arm 14, the brush 13 is held in abutment against the pressing roller 12 and inclined backward about 25 degrees. The brush 13 has flexibility, and suppresses (brakes) rotation of the pressing roller 12 by the frictional force generated when the brush 13 presses the pressing roller 12. The brush 13 of the roll paper pressing unit 11 is the rotation suppressing portion configured to suppress continuous rotation of the pressing roller 12 due to an inertial force after stop of conveyance of the sheet. The reason why continuous rotation of the pressing roller 12 due to the inertial force is suppressed by the brush 13 is described later. In FIG. 2 (*b*), only a part of the arm 14, the brush 13, and the pressing roller 12 are illustrated.

Figure 4:
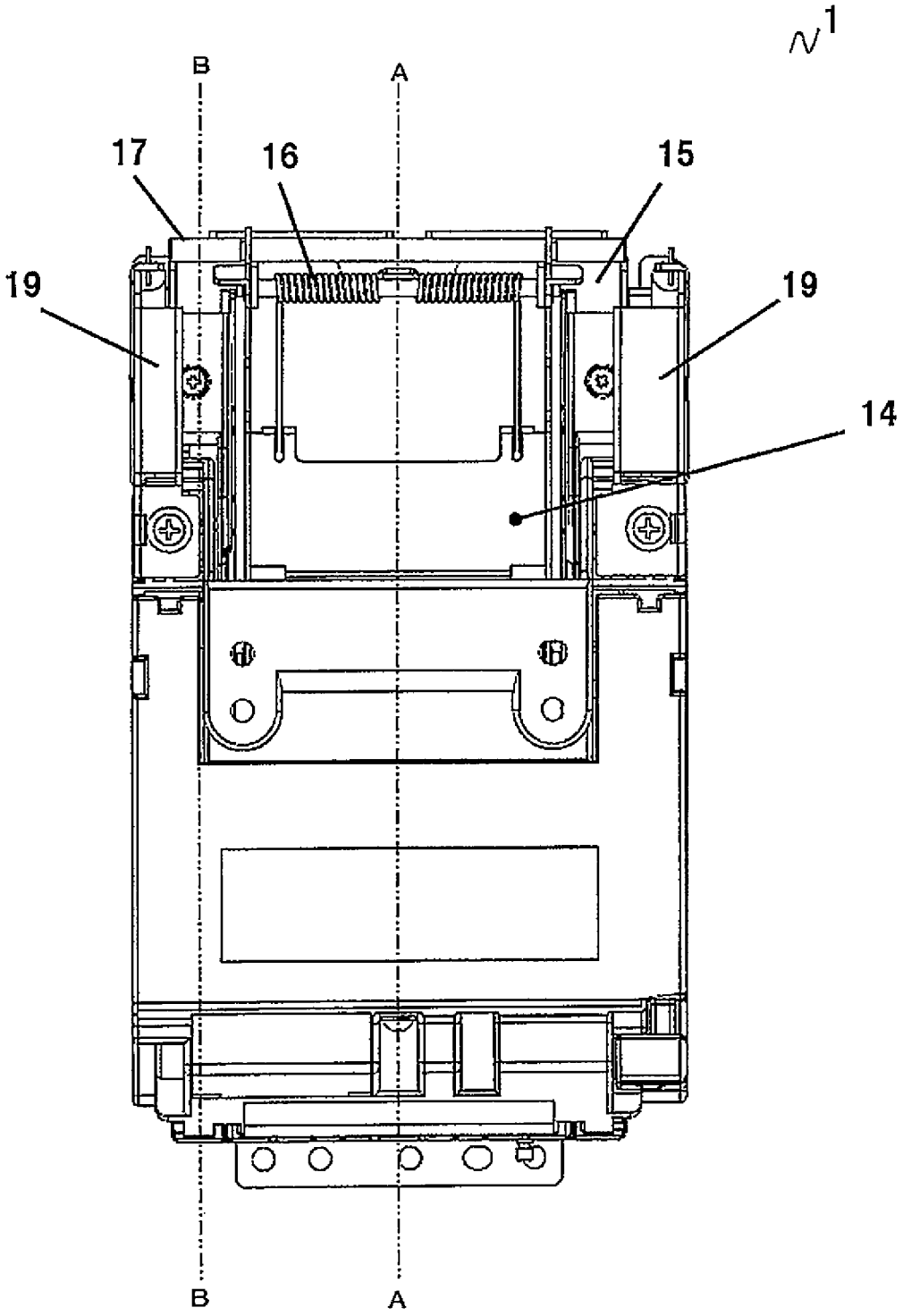
FIG. 4 is a top view for illustrating the roll paper printer 1 according to the embodiment.

FIG. 3A and FIG. 3B are sectional views for illustrating the roll paper printer 1. FIG. 4 is a top view for illustrating the roll paper printer 1 in a state illustrated in FIG. 1A. FIG. 3A is a view for illustrating a state in which the roll paper 2 has a maximum diameter, and FIG. 3B is a view for illustrating a state in which the roll paper 2 has a small diameter. FIG. 3A and FIG. 3B are sectional views taken along the line A-A of FIG. 4.

As illustrated in FIG. 3A and FIG. 3B, the roll paper 2 is received in the roll paper holding portion 21. Further, the sheet fed from the roll paper 2 enters a sheet passage inlet 22 via the pressing roller 12 of the roll paper pressing unit 11, and is conveyed along a sheet passage 23 to be output from a sheet passage outlet 24.

The arm 14 of the roll paper pressing unit 11 is urged downward along a circumference of a circle having a center at the pivot shaft 15*a*. The roll paper holding portion 21 has two bottom surfaces that form an obtuse angle (120 degrees) at a bottom. Support rollers 25*a* and 25*b* are provided on the bottom surface on the sheet passage inlet 22 side, and a support roller 25*c* is provided on the bottom surface on the opposite side. The support rollers 25*a*, 25*b*, and 25*c* are rotatable.

As illustrated in FIG. 3A, when the roll paper 2 has a maximum diameter, the roll paper 2 is supported by the two support rollers 25*b* and 25*c*, and is pushed (pressed) downward by the roll paper pressing unit 11. When the roll paper 2 has a maximum diameter, the pressing roller 12 of the arm 14 of the roll paper pressing unit 11 is rotated along with conveyance of the sheet. Further, the support rollers 25*b* and 25*c* on the bottom surfaces are rotatable. Therefore, the pressing roller 12 and the support rollers 25*b* and 25*c* do not inhibit rotation of the roll paper 2 by the frictional force. Although rotation of the pressing roller 12 is suppressed by the brush 13, a suppressing force of the brush 13 generated by friction is set to such an extent as to suppress (brake) continuous rotation of the pressing roller 12 due to the inertial force when conveyance of the sheet is stopped. Therefore, influence of the suppressing force on a pulling force required for rotating the roll paper 2 is small, and it is only required that the pulling force of pulling the sheet be increased slightly.

As illustrated in FIG. 3A, the roll paper pressing unit 11 presses the roll paper 2, and hence rolling of the roll paper 2 is suppressed by the roll paper pressing unit 11. Further, occurrence of slackness of the sheet fed from the roll paper 2 after finish of conveyance of the sheet is also suppressed by the roll paper pressing unit 11. Therefore, the sheet conveying unit 44 can stably convey the sheet fed from the roll paper 2. In a case in which the roll paper 2 has a large diameter, which includes a case of having a maximum diameter, owing to its diameter size and weight, rolling of the roll paper 2 that adversely affects conveyance of the sheet does not occur. In a case in which no roll paper pressing unit 11 is provided, as the diameter and the weight of the roll paper 2 are reduced, rolling that adversely affects conveyance of the sheet is initiated. A force of pressing the roll paper 2 by the roll paper pressing unit 11 also serves as a load on conveyance of the sheet, and hence it is preferred that the pressing force be as small as possible. Therefore, it is desired that the force of pressing the roll paper 2 by the roll paper pressing unit 11 be decreased as the diameter of the roll paper 2 is reduced, and be set to such an extent as to prevent rolling that adversely affects conveyance of the sheet from being initiated.

The reason why continuous rotation of the pressing roller 12 due to the inertial force is suppressed by the brush 13 is described. By the roll paper pressing unit 11 including the brush 13, occurrence of slackness of the sheet fed from the roll paper 2 after finish of conveyance of the sheet is suppressed. However, in the roll paper 2 before passing through the pressing roller 12, an outermost part of the roll paper 2 received in the roll paper holding portion 21 may be separated away from an inner part of the roll paper 2 so that slight slackness with slight swelling occurs. Even in this case, rotation of the pressing roller 12 is suppressed by the frictional force generated by abutment between the brush 13 and the pressing roller 12, and continuous rotation due to the inertial force is braked. Thus, the slight slackness of the roll paper 2 is retained between the pressing roller 12 and the roll paper 2. Therefore, occurrence of slackness of the sheet between the pressing roller 12 and the sheet passage inlet 22 is suppressed. In a case of the above-mentioned slight slackness of the roll paper 2 between the pressing roller 12 and the roll paper 2, the sheet is fed via the pressing roller 12 that presses the roll paper 2, and hence the slight slackness does not cause fluctuation in load that exerts an influence on printing at the time of subsequent conveyance of the sheet. The above is the reason why continuous rotation of the pressing roller 12 due to the inertial force is suppressed by the brush 13.

When the pressing roller 12 includes no brush 13, continuous rotation of the pressing roller 12 due to the inertial force is not suppressed, and the slight slackness of the roll paper 2 before passing through the pressing roller 12 is delivered via the pressing roller 12 to occur as slackness of the sheet between the pressing roller 12 and the sheet passage inlet 22. There is a fear in that this slackness of the sheet may cause fluctuation in load that exerts an influence on printing.

Incidentally, the same effects can be attained when the pressing roller 12 is fixed so as to be non-rotatable. However, when a surface of the roll paper to be brought into abutment against the non-rotatable pressing roller 12 is a surface to be printed, color may be developed, and the pressing roller 12 may be partially worn.

The arm 14 of the roll paper pressing unit 11 is urged downward along the circumference of the circle having the center at the pivot shaft 15*a*. Thus, the pressing roller 12 of the roll paper pressing unit 11 pushes (presses) the roll paper 2 against the bottom surfaces even when, as illustrated in FIG. 3B, the roll paper 2 has a small diameter in accordance with reduction in diameter of the roll paper 2. When a certain amount of the roll paper 2 is used, the roll paper 2 is separated away from the support rollers 25 and supported by the bottom surfaces. The frictional force given at this time between the roll paper 2 and the bottom surfaces of the roll paper holding portion 21 during rotation of the roll paper 2 is small because the bottom surfaces are made of plastic and the roll paper 2 is reduced in weight. The sheet conveying unit 44 can exert the above-mentioned pulling force, and hence can convey the roll paper 2 having a small diameter without any problem. Further, even when the roll paper 2 has a small diameter, the roll paper holding structure in this embodiment can suppress rolling of the roll paper 2 and occurrence of slackness of the sheet between the pressing roller 12 and the sheet passage inlet 22.

As described above, according to the roll paper holding structure of this invention, fluctuation in load on the sheet conveying unit 44 can be prevented.

Next, description is made of a mechanism for retreating the arm 14 including the pressing roller 12 of the roll paper pressing unit 11 to a predetermined position at the time of replacement of the roll paper. The arm 14 is a support portion configured to support the pressing roller 12.

Figure 5:
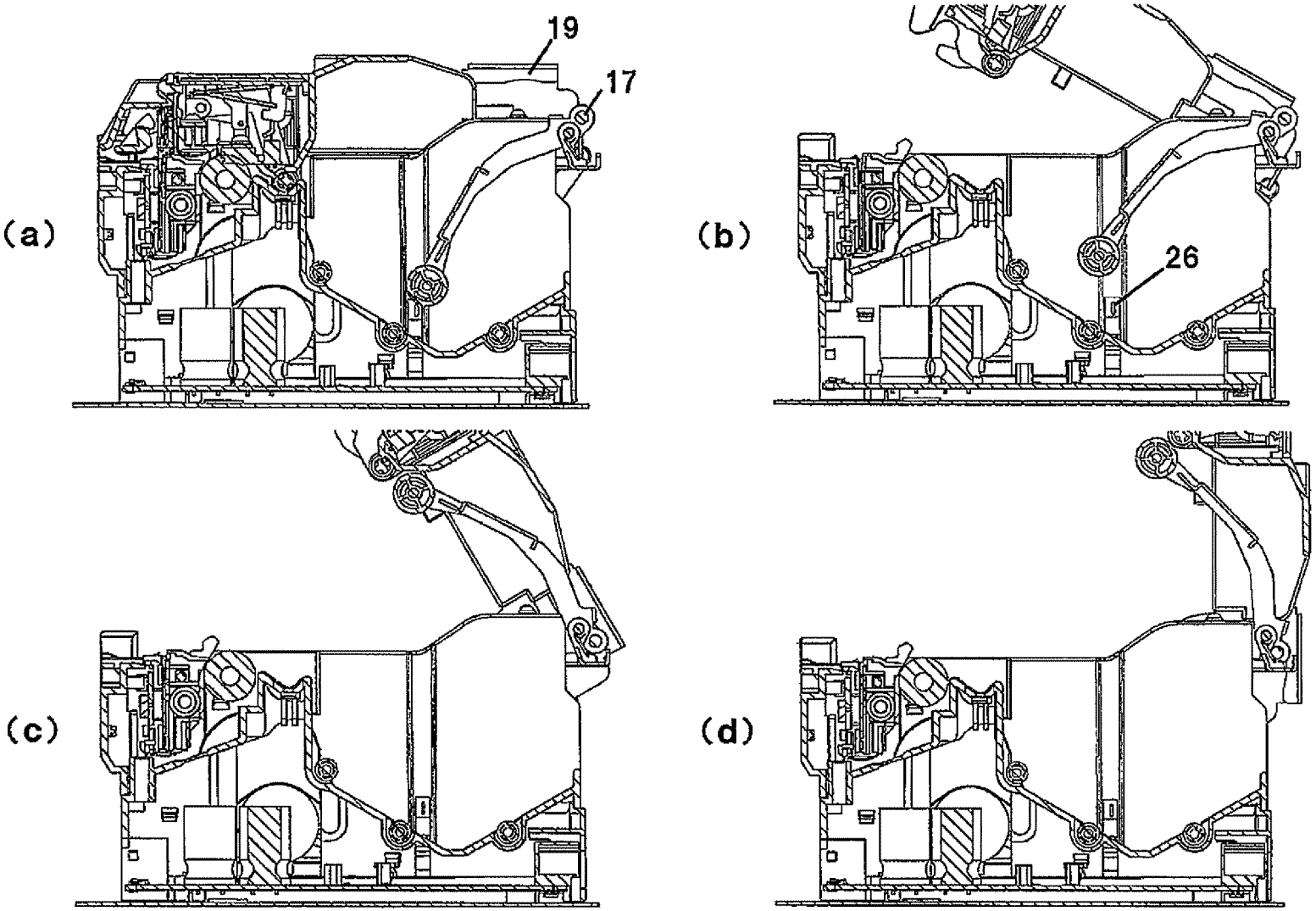
FIG. 5 includes sectional views (FIGS. 5(*a*) to 5(*d*)) for illustrating the roll paper printer 1 according to the embodiment (taken along a line A-A in FIG. 4).
Figure 6:
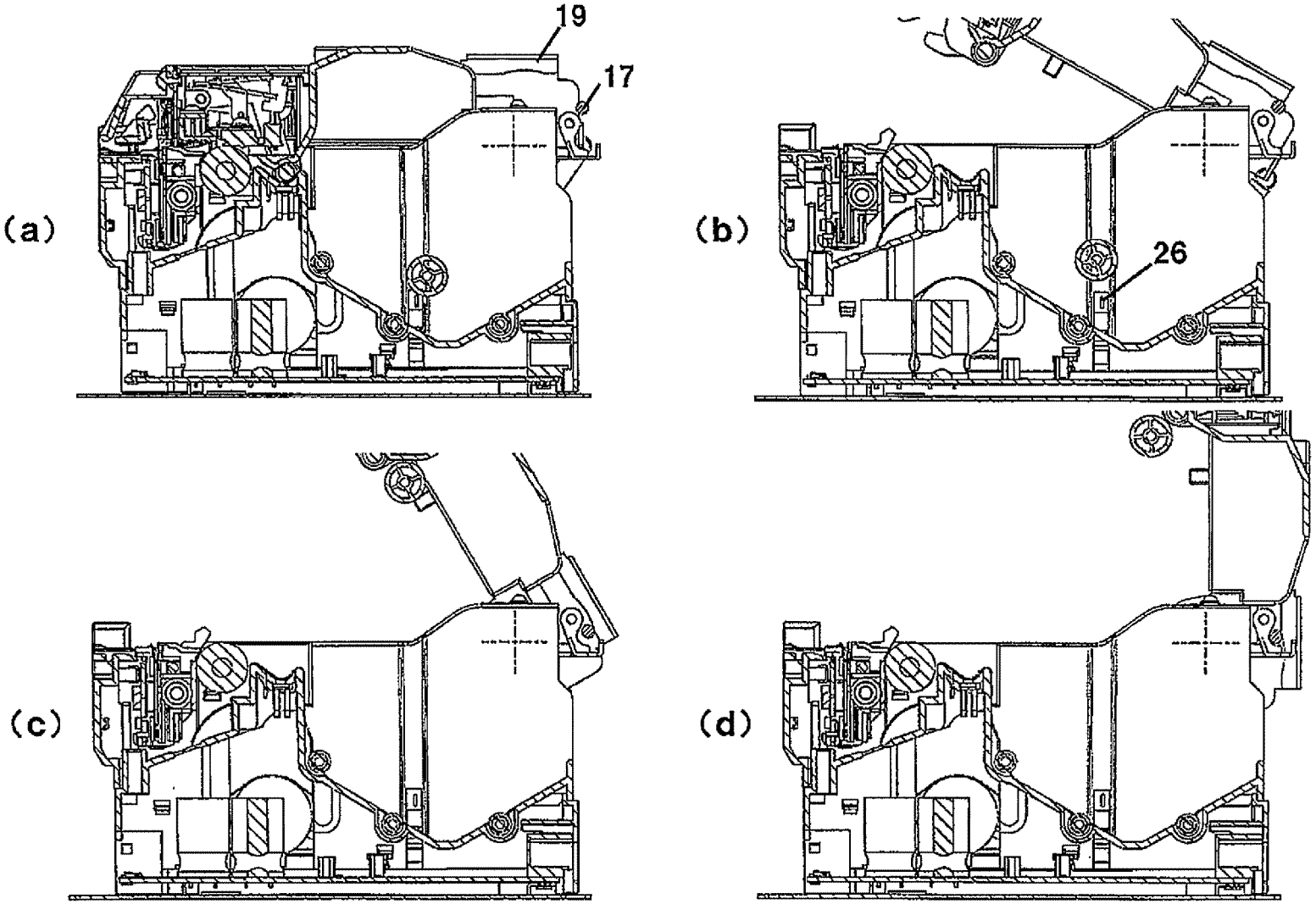
FIG. 6 includes sectional views (FIGS. 6(*a*) to 6(*d*)) for illustrating the roll paper printer 1 according to the embodiment (taken along a line B-B in FIG. 4).

FIG. 5 and FIG. 6 includes sectional views for illustrating the roll paper printer 1 according to one embodiment. FIG. 5 (*a*) to FIG. 5 (*d*) are sectional views taken along the line A-A of FIG. 4, and FIG. 6 (*a*) to FIG. 6 (*d*) are sectional views taken along the line B-B of FIG. 4. FIG. 5 (*a*), FIG. 5 (*b*), FIG. 5 (*c*), and FIG. 5 (*d*) correspond to FIG. 6 (*a*), FIG. 6 (*b*), FIG. 6 (*c*), and FIG. 6 (*d*), respectively. In FIG. 6, a center of pivoting of the upper frame 10 (center of the pivot shaft portion 30) is indicated by the intersection of alternate long and short dashed lines. In FIG. 5 and FIG. 6, the roll paper 2 is not received in the roll paper holding portion 21. Further, in FIG. 5 and FIG. 6, the brush 13 of the roll paper pressing unit 11 is not illustrated. FIG. 5 (*a*) and FIG. 6 (*a*) are illustrations of a state in which the engagement portions 31 of the upper frame 10 and the shaft of the platen roller 42 of the lower frame 20 are engaged with each other so that the upper frame 10 is closed. FIG. 5 (*b*) and FIG. 6 (*b*) are illustrations of a state in which engagement of the engagement portions 31 of the upper frame 10 is canceled so that the upper frame 10 starts opening. FIG. 5 (*c*) and FIG. 6 (*c*) are illustrations subsequent to FIG. 5 (*b*) and FIG. 6 (*b*). FIG. 5 (*d*) and FIG. 6 (*d*) are illustrations of a state in which the upper frame 10 is completely opened. A position of the arm 14 including the pressing roller 12 illustrated in FIG. 5 (*d*) and FIG. 6 (*d*) corresponds to a retreat position of the arm 14 including the pressing roller 12.

When engagement of the engagement portions 31 of the upper frame 10 is canceled so that the upper frame 10 starts opening, along with this, as illustrated in FIG. 5 (*b*) and FIG. 6 (*b*), a retreat shaft pressing portion 19 provided to the upper frame 10 starts coming into abutment against the retreat shaft 17 of the arm 14. When the upper frame 10 is further opened, as illustrated in FIG. 5 (*c*) and FIG. 6 (*c*), the retreat shaft pressing portion 19 presses the retreat shaft 17, and hence the retreat shaft 17 of the arm 14 is moved along a shape of the retreat shaft pressing portion 19. Under this state in which the upper frame 10 is not completely opened, the arm 14 including the pressing roller 12 of the roll paper pressing unit 11 is moved to a position close to the upper frame 20. With this structure, when the roll paper is thrown into the printer by a user, the roll paper 2 can be prevented from being erroneously thrown between the upper frame 10 and the pressing roller 12 of the roll paper pressing unit 11.

The above description relates to the retreat shaft 17 of the roll paper pressing unit 11 and the retreat shaft pressing portion 19 on the illustrated side (left side seen from a side on which the printed sheet is discharged). The right side also has the same structure.

Further, description is made of a function of detecting a near-end of the roll paper in the roll paper printer 1 according to this invention. Herein, the near-end of the roll paper refers to a state in which a diameter of the roll paper 2 is reduced to a predetermined diameter or less, that is, a state in which a remaining amount of the roll paper 2 is reduced to an amount requiring replacement. The function of detecting the near-end of the roll paper is, in other words, a small-remaining-amount roll paper detection function of detecting that the remaining amount of the roll paper is small. When the roll paper printer 1 detects the near-end, the roll paper printer 1 sends a signal to a host device, and the host device, for example, outputs a message to the effect that replacement of the roll paper 2 is needed.

Figure 7:
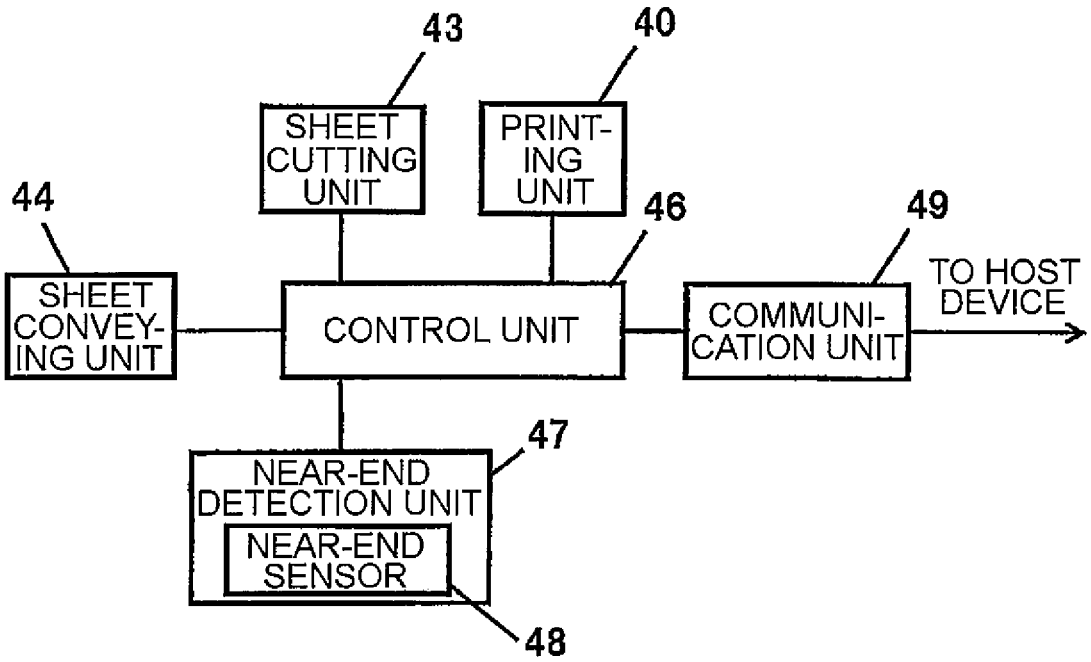
FIG. 7 is an electrical block configuration diagram for illustrating the roll paper printer 1 having the roll paper holding structure.

FIG. 7 is an electrical block configuration diagram for illustrating the roll paper printer 1 having the roll paper holding structure of this invention. The roll paper printer 1 includes a control unit 46, the sheet conveying unit 44, a printing unit 40, the sheet cutting unit 43, a near-end detection unit 47, and a communication unit 49. The control unit 46 is configured to control components of the roll paper printer 1, and to cause the components to perform processing. The sheet conveying unit 44 is configured to convey the sheet fed from the roll paper 2. The printing unit 40 is configured to perform printing on the sheet. The sheet cutting unit 43 is configured to cut the sheet. The near-end detection unit 47 is configured to detect the near-end of the roll paper 2 based on a signal from a near-end sensor 48. The near-end detection unit 47 is, in other words, a small-remaining-amount roll paper detection unit. The communication unit 49 is configured to perform communication with the host device (such as a point-of-sales (POS) terminal device). When the near-end of the roll paper 2 is detected by the near-end detection unit 47, the control unit 46 of the roll paper printer 1 sends information of detection of the near-end to the host device through the communication unit 49.

The near-end sensor 48 is an optical sensor (photosensor). For detection of the near-end of the roll paper 2, as illustrated in FIG. 5 and FIG. 6, a detection window 26 is formed in a lower portion of the roll paper holding portion 21. The detection window 26 allows the near-end sensor 48 (not shown) to emit light or receive reflected light. The detection window 26 is formed in the roll paper holding portion 21 at a position of detecting the near-end of the roll paper 2, that is, a position of detecting that the diameter of the roll paper 2 is reduced to a predetermined diameter or less. In other words, there is provided a structure in which a position of the pressing roller 12 configured to press the roll paper 2 having the diameter reduced to a predetermined diameter or less, and a position of the detection window for the near-end sensor 48 have a predetermined positional relationship (predetermined distance and angle). The optical sensor in this embodiment is a reflective photosensor (photoreflector) configured to detect reflected light. However, the optical sensor may be a transmissive photosensor (photointerrupter) configured to detect whether or not transmitted light is blocked.

When the roll paper 2 is further consumed from the state illustrated in FIG. 3B and then the diameter of the roll paper 2 is reduced to a predetermined diameter or less, the near-end sensor 48 detects the near-end of the roll paper 2 based on output from the optical sensor. In a case in which no roll paper pressing unit 11 is provided, even when the diameter of the roll paper 2 is reduced to a predetermined diameter or less that is to be detected as the near-end, the roll paper 2 may not stay at a predetermined position. As a result, there is a fear in that the roll paper 2 remains at a position at which detection by the near-end sensor 48 is impossible, or that the roll paper 2 is in such a posture (for example, inclined posture) or shape (for example, swelling shape or slack shape) that detection by the near-end sensor 48 is impossible.

In contrast, in a case of the roll paper holding structure of this invention, the roll paper printer 1 includes the roll paper pressing unit 11. Thus, the roll paper 2 having the diameter reduced to a predetermined diameter or less stays at a position at which the near-end sensor 48 detects the near-end of the roll paper, thereby being capable of stably detecting the near-end of the roll paper 2.

As described above, according to this invention, it is possible to provide the roll paper printer including the roll paper holding portion capable of suppressing rolling of the roll paper and occurrence of slackness of the sheet.

The embodiment of this invention is described as an example. However, a specific configuration of this invention is not limited to the above-mentioned embodiment.

In the above-mentioned embodiment, the brush 13 made of plastic is provided as the rotation suppressing portion for the pressing roller 12. However, the brush 13 may be made of a different material (for example, metal) as long as the brush 13 can obtain a predetermined frictional force (suppressing force) by pressing the pressing roller 12. Further, in the above-mentioned embodiment, the brush 13 serving as the rotation suppressing portion is provided on a side on which the pressing roller 12 is held in abutment against the roll paper 2. However, the brush 13 may be provided on a side on which the pressing roller 12 is not held in abutment against the roll paper 2. Further, instead of the shape of the brush 13, there may be employed a structure in which a plate-like component presses the pressing roller 12 by an elastic component such as a spring. Further, there may be employed a mechanism that is provided between the rotation shaft of the pressing roller 12 and a shaft support portion therefor and configured to, without suppressing rotation by pressing the pressing roller 12 from an outer side, generate a predetermined frictional force along with rotation of the pressing roller 12. This mechanism may be used as the rotation suppressing portion.

Further, in the above-mentioned embodiment, the thermal printer is described. However, this invention is applicable also to a printer of another throw-in type using the roll paper 2, for example, to an inkjet printer of a throw-in type using the roll paper 2.

EXPLANATION OF REFERENCE SIGNS

1 roll paper printer
2 roll paper
10 upper frame
11 roll paper pressing unit
12 pressing roller
13 brush
14 arm
15 base portion

15*a* pivot shaft
16 coil spring (torsion bar spring)
17 retreat shaft
18*a* positioning hole
18*b* screw mounting hole
18*c* fitting portion
19 retreat shaft pressing portion
20 lower frame
21 roll paper holding portion
22 sheet passage inlet
23 sheet passage
24 sheet passage outlet
25 support roller
26 detection window
30 pivot shaft portion
31 engagement portion
32 spring
40 printing unit
41 thermal head
42 platen roller
43 sheet cutting unit
44 sheet conveying unit
45 disengaging lever
46 control unit
47 near-end detection unit
48 near-end sensor (optical sensor)
49 communication unit

The invention claimed is:

1. A roll paper printer, comprising:

a roll paper holding portion configured to hold roll paper without axially supporting the roll paper;

a sheet conveying unit configured to convey a sheet fed from the roll paper;

a printing unit configured to perform printing on the sheet; and a roll paper pressing unit configured to press the roll paper held in the roll paper holding portion, wherein the roll paper pressing unit includes:

a pressing roller configured to press the roll paper and rotate along with conveyance of the sheet; and a rotation suppressing portion configured to suppress rotation of the pressing roller by a frictional force, wherein the roll paper pressing unit presses the roll paper against a bottom surface of the roll paper holding portion when the roll paper is reduced to a predetermined diameter or less, wherein the roll paper printer has a structure in which the sheet fed from the roll paper reduced to a predetermined diameter or less enters into a passage of the sheet conveying unit via the pressing roller after the sheet is separated from a roll portion of the roll paper;

wherein the rotation suppressing portion is a structural body configured to brake, by the frictional force, continuous rotation of the pressing roller due to an inertial force after stop of conveyance of the sheet; and wherein the rotation suppressing portion comprises a brush configured to press the pressing roller.

2. The roll paper printer according to claim 1, including an upper frame and a lower frame, wherein the upper frame is pivotable upward about a pivot shaft provided to the lower frame, wherein the roll paper pressing unit includes a retreat shaft, wherein the upper frame includes a retreat shaft pressing portion, and wherein the retreat shaft pressing portion of the upper frame is brought into abutment against the retreat shaft of the roll paper pressing unit along with pivoting of the upper frame to press the retreat shaft, and thus moves the pressing roller and a support portion for the pressing roller to a retreat position.

3. The roll paper printer according to claim 1, further comprising a small-remaining-amount roll paper detection unit configured to detect that a diameter of the roll paper is reduced to a predetermined diameter or less, wherein the roll paper pressing unit has a structure for causing the roll paper having the diameter reduced to the predetermined diameter or less to stay at a position at which the small-remaining-amount roll paper detection unit is capable of detecting that the diameter of the roll paper is reduced to the predetermined diameter or less.

* * * * *